US006945844B2

(12) United States Patent
Hubbell, III

(10) Patent No.: US 6,945,844 B2
(45) Date of Patent: Sep. 20, 2005

(54) METHODS FOR DYNAMICALLY CONTROLLING A SEMICONDUCTOR DICING SAW

(75) Inventor: Edward J. Hubbell, III, Durham, NC (US)

(73) Assignee: Cree, Inc., Durham, NC (US)

( * ) Notice: Subject to any disclaimer, the term of this patent is extended or adjusted under 35 U.S.C. 154(b) by 14 days.

(21) Appl. No.: 10/606,980

(22) Filed: Jun. 26, 2003

(65) Prior Publication Data

US 2004/0029491 A1 Feb. 12, 2004
US 2005/0159081 A9 Feb. 12, 2004

Related U.S. Application Data

(60) Provisional application No. 60/398,753, filed on Jul. 26, 2002.

(51) Int. Cl.[7] ..... B24B 49/00; B24B 51/00

(52) U.S. Cl. ..... 451/5; 451/8; 451/9; 451/10; 451/41; 125/12; 125/13.01

(58) Field of Search ..... 451/5, 8–10, 41; 125/12, 13.01; 83/34, 42, 56, 76.8, 368, 370, 875, 879–881

(56) References Cited

U.S. PATENT DOCUMENTS 3,618,270 A * 11/1971 Koide ..... 451/24
5,282,404 A * 2/1994 Leighton et al. ..... 83/13
5,628,673 A * 5/1997 Morooka ..... 451/9
5,668,061 A * 9/1997 Herko et al. ..... 438/463
5,718,615 A * 2/1998 Boucher et al. ..... 451/5
5,865,163 A * 2/1999 Wildes et al. ..... 125/16.02
6,152,803 A * 11/2000 Boucher et al. ..... 451/12
6,165,051 A * 12/2000 Weisshaus et al. ..... 451/8
6,357,330 B1 * 3/2002 Dass et al. ..... 83/863
2002/0031899 A1 * 3/2002 Manor ..... 438/460
2002/0032533 A1 * 3/2002 Sangiacomo ..... 702/42

FOREIGN PATENT DOCUMENTS

JP 63319110 A * 12/1988 ..... B28D/5/00

* cited by examiner

*Primary Examiner*—Joseph J. Hail, III
*Assistant Examiner*—Bryan Muller
(74) *Attorney, Agent, or Firm*—Myers Bigel Sibley & Sajovec

(57) ABSTRACT

A saw cutting pattern is dynamically established for a semiconductor dicing saw based on detection of the saw blade contacting a wafer or a portion of a wafer. The dynamic cutting pattern may terminate cuts if the saw blade no longer contacts the wafer or a portion of a wafer. Thus, irregular shaped wafers may be cut without requiring that an entire predefined cutting pattern be carried out and/or without previously mapping the shape of the wafer or portion of a wafer. A map of the wafer or a portion of a wafer may also be generated based on the detection of the saw blade contacting the wafer during a first cutting pass and may be used during a second cutting pass.

13 Claims, 5 Drawing Sheets

METHODS FOR DYNAMICALLY CONTROLLING A SEMICONDUCTOR DICING SAW

RELATED APPLICATIONS

The present application is related to and claims priority from U.S. Provisional Application Ser. No. 60/398,753, filed Jul. 26, 2002 and entitled "Methods, Systems and Computer Program Products for Controlling a Semiconductor Dicing Saw," the disclosure of which is incorporated herein as if set forth in its entirety.

FIELD OF THE INVENTION

The present invention relates to fabrication of semiconductor devices, and in particular to dicing wafers into individual components by means of a dicing saw.

BACKGROUND

Semiconductor devices are typically fabricated on a substrate that provides mechanical support for the device and often contributes to the electrical performance of the device as well. Silicon, germanium, gallium arsenide, sapphire and silicon carbide are some of the materials commonly used as substrates for semiconductor devices. Many other materials are also used as substrates. Semiconductor device manufacturing typically involves fabrication of many semiconductor devices on a single substrate.

Substrates are typically formed in the shape of circular wafers having a diameter presently ranging, for example, from less than 1 inch (2.54 cm) to over 12 inches (30.5 cm) depending on the type of material involved. Other shapes such as for example square, rectangular or triangular wafers are possible, however. Semiconductor devices are formed on the wafers by the precise formation of thin layers of semiconductor, insulator and metal materials which are deposited and patterned to form useful semiconductor devices such as diodes, transistors, solar cells and other devices.

Individual semiconductor devices are typically extremely small compared to the size of the wafer on which they are formed. For example, a typical light emitting diode (LED) chip such as the C430-XB290 LED chip manufactured by Cree, Inc., in Durham, N.C. measures only about 290 microns by 290 microns square (1 micron=0.0001 cm). Accordingly, a very large number of LED chips (also referred to as "die") may be formed on a single 2 inch (5.08 cm) diameter silicon carbide (SiC) wafer. After the die are formed on the wafer, it is necessary to separate at least some of the individual die so that they can be mounted and encapsulated to form individual devices. The process of separating the individual die is sometimes referred to as "dicing" the wafer.

Dicing a wafer into individual semiconductor devices may be accomplished by a number of methods. One method of dicing a wafer involves mounting the wafer on an adhesive surface and sawing the wafer with a circular saw. A series of closely spaced saw cuts is made first in one direction and then in a second direction perpendicular to the first direction. Thereby, a number of individually diced, square or rectangular shaped devices are produced. Other methods of dicing, such as "scribe-and-break" are possible. However, sawing may be preferable for certain applications and substrate types. In particular, for the fabrication of LEDs on silicon carbide substrates, sawing may be preferable.

Sawing may be a slow, laborious task that is typically performed using expensive, complicated saws. Because of the precision required, dicing saws are typically computer-controlled. In addition, the saws typically cut the wafers very slowly to prevent damage to the semiconductor devices. All of these factors tend to make dicing a time-consuming bottleneck in the semiconductor device fabrication process.

Accordingly, there is a need in the art for controlling a semiconductor dicing saw in a manner that may decrease the time required to dice a wafer and/or may improve wafer throughput in the semiconductor device manufacturing process.

SUMMARY OF THE INVENTION

Embodiments of the present invention provide methods, systems and computer program products for controlling a semiconductor dicing saw by dynamically adjusting a saw cut pattern of the semiconductor dicing saw during a sawing operation of at least a portion of a semiconductor wafer. For example, a saw cut pattern of the semiconductor dicing saw may be dynamically adjusted based on detection of a saw blade of the dicing saw contacting the semiconductor wafer. As used herein, the term "semiconductor wafer" refers to a wafer having at least one region of semiconductor material irrespective of whether a substrate of the wafer itself is a semiconductor material. For example, a layer of semiconductor material may be provided on a non-semiconductor material substrate to provide a semiconductor wafer. Furthermore, as used herein, the term "wafer" refers to a complete wafer or a portion of a wafer. Thus, the term wafer may be used to describe an entire wafer or part thereof, for example, if a complete wafer is broken in fabrication such that only a portion of the wafer remains usable or if different devices are fabricated on the wafer and the wafer is separated into different device portions prior to those portions being sawn into individual devices.

In particular embodiments of the present invention, dynamically adjusting a saw cut pattern is provided by terminating a current saw cut of the semiconductor dicing saw upon detection that the saw blade no longer contacts the semiconductor wafer and proceeding to a subsequent saw cut upon termination of the current saw cut. Proceeding to a subsequent saw cut may include beginning the subsequent saw cut at a start position based upon detection of when the saw blade is in contact with the semiconductor wafer of the current saw cut. Furthermore, terminating the current saw cut may be provided by detecting that the saw blade no longer contacts the semiconductor wafer, waiting a predefined time and/or distance of travel of the saw blade after it is detected that the saw blade no longer contacts the semiconductor wafer and terminating the current saw cut if after the predefined time and/or distance the saw blade still no longer contacts the semiconductor wafer.

In still further embodiments of the present invention, dynamically adjusting the saw cut pattern of the semiconductor dicing saw may be provided by detecting a level of strain of the saw during a saw cut and dynamically adjusting the saw cut pattern of the semiconductor dicing saw based on the detected level of strain indicating when the saw blade is contacting the semiconductor wafer. The level of strain may be detected by, for example, detecting strain associated with a drive shaft of the saw and/or sensing current provided to a drive motor of the saw.

In particular embodiments of the present invention, the saw cut pattern of the semiconductor dicing saw is adjusted if the detected level of strain falls below a predefined strain threshold. The predefined strain threshold may be based on cut depth, wafer thickness, blade wear and/or blade rotational speed.

In still other embodiments of the present invention; the shape of at least a portion of the semiconductor wafer is mapped based on the dynamically adjusted saw cut pattern. For example, the map may be based on detecting when the saw blade is contacting the at least a portion of the semiconductor wafer. The shape may be mapped during a first cutting pass of the semiconductor wafer. Additionally, a path of the saw blade for a second cutting pass may be established based on the mapped shape of a portion of the semiconductor wafer.

In additional embodiments of the present invention, a minimum saw cut length is provided for each saw cut irrespective of detection of the saw blade of the dicing saw contacting the semiconductor wafer. Furthermore, the wafer may be a SiC wafer. Also, at least one saw cut of the saw cut pattern may not extend completely through the semiconductor wafer.

In still other embodiments of the present invention, a system for controlling a semiconductor dicing saw includes a contact sensor circuit configured to sense when a blade of the dicing saw is in contact with a semiconductor wafer. A dicing saw controller circuit is configured to control saw cuts of the semiconductor dicing saw and includes an adaptive saw cut circuit configured to dynamically adjust a saw cut during the saw cut based on whether the contact sensor circuit senses that the blade of the dicing saw is in contact with the semiconductor wafer.

The adaptive saw cut circuit may be further configured to terminate a current saw cut of the semiconductor dicing saw upon detection that the saw blade no longer contacts the at least a portion of the semiconductor wafer and proceed to a subsequent saw cut upon termination of the current saw cut. The adaptive saw cut circuit may also be configured to begin the subsequent saw cut at a start position based upon detection of when the saw blade is in contact with the semiconductor wafer of the current saw cut.

In certain embodiments of the present invention, the adaptive saw cut circuit is further configured to wait a predefined time and/or distance of travel of the saw blade after it is detected that the saw blade no longer contacts the semiconductor wafer and terminate the current saw cut if after the predefined time and/or distance the saw blade still no longer contacts the semiconductor wafer.

In still further embodiments of the present invention, the contact sensor circuit is configured to detect a level of strain of the saw during a saw cut and the adaptive saw cut circuit is further configured to dynamically adjust a saw cut pattern of the semiconductor dicing saw based on the detected level of strain indicating when the saw blade is contacting a semiconductor wafer. The contact sensor circuit may detect strain associated with a drive shaft of the saw and/or current provided to a drive motor of the saw. The adaptive saw cut circuit may be further configured to dynamically adjust a saw cut pattern of the semiconductor dicing saw if the detected level of strain falls below a predefined strain threshold. The predefined strain threshold may be based on cut depth, wafer thickness, blade wear and/or blade rotational speed.

In additional embodiments of the present invention, the adaptive saw cut circuit is further configured to map a shape of at least a portion of the semiconductor wafer based on detecting when the saw blade is contacting the semiconductor wafer.

The adaptive saw cut circuit may be configured to map a shape during a first cutting pass of the portion of the semiconductor wafer. The adaptive saw cut circuit may be further configured to establish a path of the saw blade for a second cutting pass of the portion of the semiconductor wafer based on the mapped shape of the portion of the semiconductor wafer.

The adaptive saw cut circuit may also be configured to provide a minimum saw cut length for each saw cut irrespective of detection of the saw blade of the dicing saw contacting the semiconductor wafer.

DETAILED DESCRIPTION

The present invention now will be described more fully hereinafter with reference to the accompanying drawings, in which embodiments of the invention are shown. This invention should not be construed as limited to the embodiments set forth herein; rather, these embodiments are provided so that this disclosure will be thorough and complete, and will fully convey the scope of the invention to those skilled in the art. Like numbers refer to like elements throughout. Furthermore, the various layers and regions illustrated in the figures are illustrated schematically. As will also be appreciated by those of skill in the art, while the present invention is described with respect to semiconductor wafers and diced chips, such chips may be diced into arbitrary sizes. Accordingly, the present invention is not limited to the relative size and spacing illustrated in the accompanying figures.

As will be appreciated by one of skill in the art, the present invention may be embodied as a methods, systems (apparatus), and/or computer program products. Accordingly, the present invention may take the form of an entirely hardware embodiment, an entirely software embodiment or an embodiment combining software and hardware aspects, all generally referred to herein as a "circuit." Furthermore, the present invention may take the form of a computer program product on a computer-usable storage medium having computer-usable program code means embodied in the medium. Any suitable computer readable medium may be utilized including hard disks, CD-ROMs, optical storage devices, a transmission media such as those supporting the Internet or an intranet, or magnetic storage devices.

Computer program code for carrying out operations of the present invention may be written in an object oriented programming language such as Java®, Smalltalk or C++. However, the computer program code for carrying out operations of the present invention may also be written in conventional procedural programming languages, such as the "C" programming language. The program code may execute entirely on a single computer and/or data processing system, partly on a first computer and/or data processing system, as a stand-alone software package or as part of another software package, partly on a first computer and/or data processing system and partly on one or more remote computers and/or data processing systems or entirely on one or more remote computers and/or data processing systems. The remote computer(s) may be connected to the first computer directly, through a local area network (LAN), a wide area network (WAN), a wireless communication media, a wired communication media or other such inter-networking media, or the connection may be made through one or more external computers and/or data processing systems (for example, through the Internet using an Internet Service Provider or through a packet switched or circuit switched network, such as a telephony network).

Figure 1A:
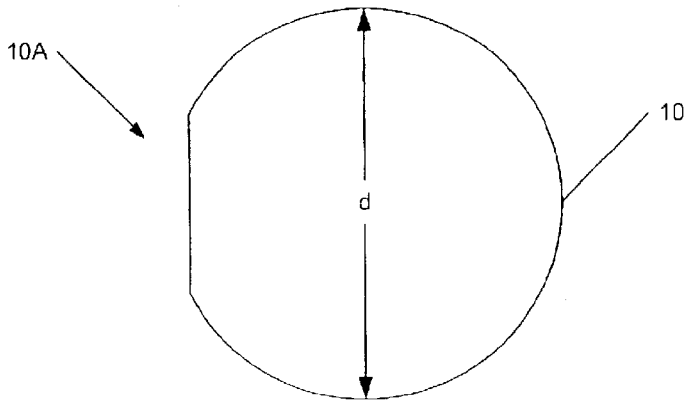
FIGS. 1A–C are diagrams illustrating a wafer and conventional sawing techniques.

FIG. 1A illustrates a typical semiconductor substrate formed in the shape of a generally circular wafer 10. The wafer 10 includes at least a primary flat 10A for orientation. For silicon carbide wafers sold by Cree, Inc., the primary flat is oriented such that the chord is formed parallel to the <112-0> crystallographic direction. A smaller secondary flat (not shown) may also be formed along an edge of the wafer perpendicular to the primary flat. The primary and secondary flats are used to orient the wafer during various processing operations, such as device fabrication and separation.

Figure 1B:
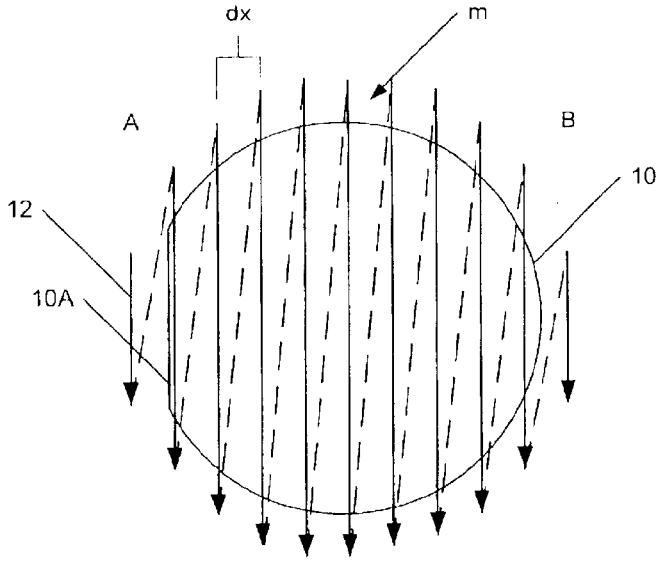

FIG. 1B illustrates the general movement of a saw blade across the wafer 10 during a sawing operation. As explained above, at last some of the individual semiconductor devices ("dice") formed on a wafer must be separated prior to packaging. One way of separating the dice is by sawing the wafer into square or rectangular pieces. Other shapes, such as triangles, also may be provided. Prior to sawing, the wafer 10 is mounted with an adhesive in a wafer carrier (not shown) that holds the wafer 10 and the separated die in place while being sawed.

Sawing is accomplished by moving a rotating saw blade across the wafer as illustrated in FIG. 1B. Beginning at point "A" shown on FIG. 1B, the saw blade is moved in the direction illustrated by solid line 12 over a distance based on a circular path established by the diameter "d" of the wafer 10 plus an additional distance "m" that acts as a safety margin to ensure that the saw is a sufficient distance from the wafer before it is recovered and to compensate for any deviation in placement of the wafer 10.

Once the saw blade has traveled the entire distance indicated by solid line 12, the blade is lifted away from the wafer and moved back to its next starting position, as illustrated by the dashed lines. The next starting position is based upon the assumed d+2m cutting diameter and where the previous cut occurred within a circle of diameter d+2m. The wafer 10 is also-moved laterally a precise distance dx so that the saw blade is properly positioned to make the next cut along solid line. In effect, the saw blade is recovered along a path indicated by dashed lines to the beginning of the next saw cut, which is located a distance "dx" away from the previous cut. The process is repeated along the entire width of the wafer until a series of parallel cuts have been made in the wafer along its entire width.

Figure 1C:
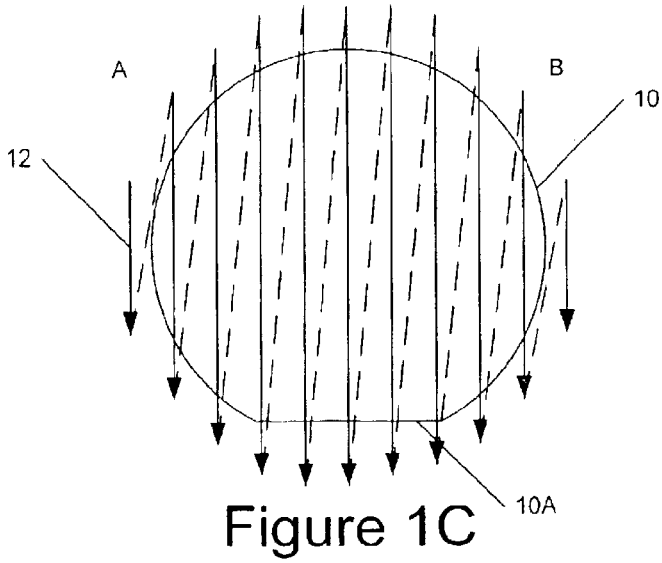

Once a first series of cuts (i.e. a first saw cut pass) has been made as illustrated in FIG. 1B, the wafer is rotated 90 degrees so that the saw blade is now positioned to make a second series of cuts perpendicular to the first series, as illustrated in FIG. 1C. After the second series of cuts is complete, the wafer has been separated into individual dice having square, rectangular or other perimeters. The resulting dice may be packaged as described above.

In a conventional sawing tool, the cut pattern is based on wafer diameter and the "safety factor" m. That is, each cut is made a distance based on a circular wafer of diameter d plus twice the safety margin m. Oftentimes, however, it is necessary or desirable to dice a substrate that is only a piece of a wafer. Wafers may be broken during processing (intentionally or unintentionally). Rather than discarding the broken wafer, it i often possible to continue processing the broken wafer fragment and obtain useful devices therefrom. However, the cut pattern of a conventional sawing tool typically may not be modified to take into account the fact that the wafer being diced is not circular in shape.

The inability to account for variations in shape may result in unnecessary throughput delays in a dicing operation. For example, a 2 inch (5.08 cm) SiC wafer that has 160 cuts per side may take as much as 90 minutes to perform the cuts for each direction cut. If some of these cuts need not be performed for their entire length, the throughput of the dicing saw may be increased.

One approach to such issues has been to use machine imaging to determine the shape of the wafer and/or portion of a wafer. For example, the DISCO 641 saw from DISCO Corporation)May utilize a visual process to "see" the wafer and generate an acceptable cut pattern for a wafer. However, such systems may involve complex and expensive optical and image recognition techniques to determine the shape of the wafer being diced. Alternatively, a software solution that loads maps of the wafer being diced into the saw has been proposed. However, such a solution is based on the availability of maps of the wafer shape prior to dicing.

Figure 2:
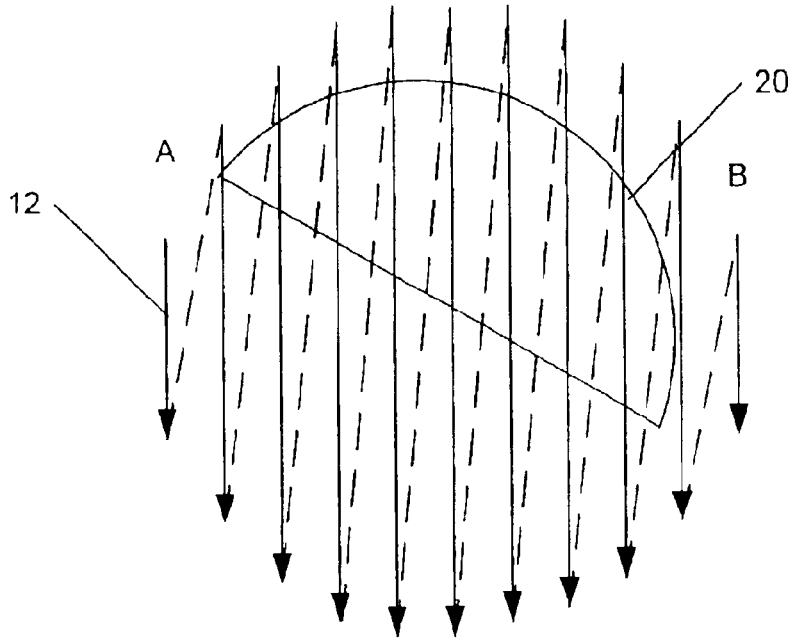
FIG. 2 is a diagram of application of a conventional sawing technique to a portion of a wafer.

An example of dicing a portion of a wafer 20 utilizing a conventional technique having a fixed saw cut pattern is illustrated in FIG. 2. As seen in FIG. 2, the cut pattern of the saw may provide substantial overshoot for each cut 12 of the saw from the initial cut at point A to the final cut at point B. Such overshoot may take a substantial amount of time and, thereby, reduce throughput for the saw.

Figure 3:
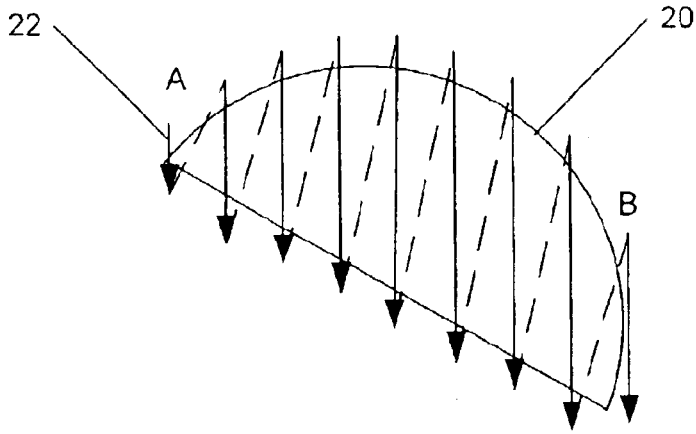
FIG. 3 is a diagram of application of sawing techniques according to embodiments of the present invention to a portion of a wafer.

In contrast to the fixed saw cut pattern of a conventional system, embodiments of the present invention provide an adaptive saw cut pattern that is provided without the need for optical imaging of the wafer being diced. Such an adaptive saw cut pattern is illustrated in FIG. 3. As seen in FIG. 3, the saw cut pattern 22 begins at point A and traverses the portion of the wafer to point B. The saw cut pattern 22 more closely matches the shape of the portion of the wafer 20 and, therefore, may reduce cutting time over a fixed saw cut pattern as illustrated in FIG. 2.

In some embodiments of the present invention, the adaptive saw cut pattern 22 may be provided by sensing when the dicing saw is in contact with the portion of the wafer 20 and terminating a saw cut and proceeding to a next saw cut when it is sensed that the dicing saw is no longer in contact with the portion of the wafer 20. Such sensing may, for example, be provided by detecting a level of strain in the saw utilizing, for example, strain gauges associated with the drive shaft of the saw blade, sensing current provided to the drive motor of the saw and/or the like. Furthermore, conventional saws, such as those provided by Kulicke and Soffa Industries, Inc. (K&S) of Willow Grove, Pa. may be modified according to embodiments of the present invention to utilize strain gauges already present in the dicing saws to provide an adaptive saw cut pattern. Thus, a dicing saw may obtain loaded cut lengths (i.e. the length where the saw is cutting the wafer) and utilize such information to adjust the cutting pattern based on the specific wafer or portion of a wafer being cut.

When it is determined that the saw blade is no longer in contact with the wafer, the saw blade is positioned for the next cut. In certain embodiments of the present invention, the initial start position of each subsequent cut may be predicted based on the position where the saw blade first came into contact with the wafer or portion of the wafer on the previous saw cut. Such a prediction may, for example, be based on an assumption that the wafer or portion of the wafer has a predefined shape, such as a substantially circular shape. In other embodiments of the present invention, the initial start position for a subsequent cut may be pre-established, such as, for example, utilizing the initial start positions for the saw cut pattern illustrated in FIG. 2. In either case, the wafer or portion of the wafer may be positioned on the wafer carrier in such a manner so as to reduce the likelihood of erroneous starting position estimates and/or to reduce the distance the saw blade traverses from its initial starting position before contacting the wafer or portion of a wafer.

Additionally, in some embodiments of the present invention where two saw cut passes are utilized, position information from the wafer carrier may be correlated with the sensed contact information for the first saw cut pass to provide a map of the shape of the wafer or portion of wafer being cut. Such a map may then be used in the second saw cut pass to provide the saw cut pattern for the second pass.

Figure 4:
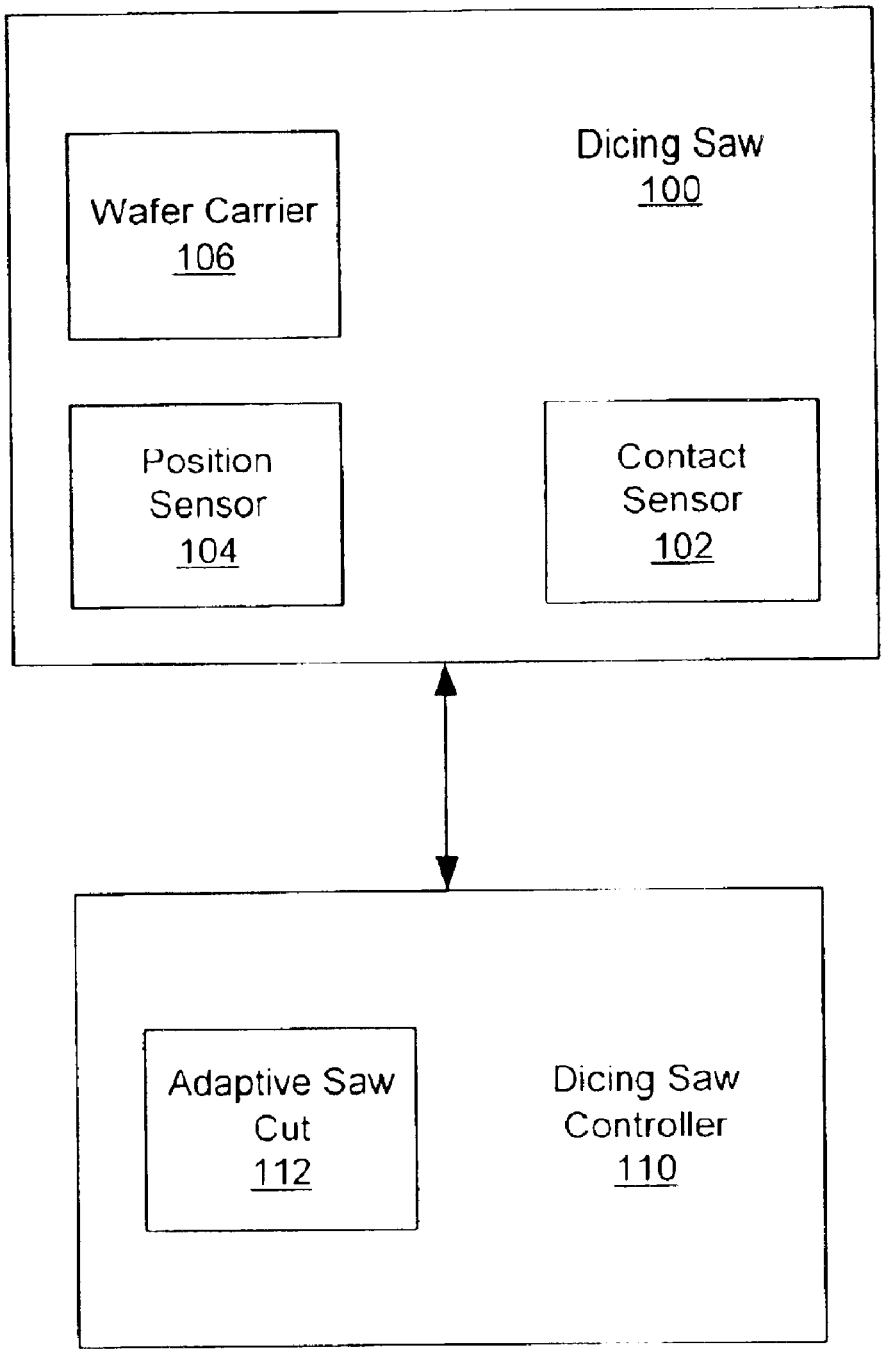
FIG. 4 is a block diagram of a dicing saw according to embodiments of the present invention.

The adaptive saw cut pattern 22 as illustrated in FIG. 3 may be provided by a system as illustrated in FIG. 4. As seen in FIG. 4, the dicing saw 100 includes a contact sensor module/circuit 102 that senses when the saw blade is in contact with the wafer or portion of wafer being cut. As described above, the contact sensor circuit/module 102 may, for example, utilize strain gauges, current sensors or the like to sense the load of the saw blade that is present when the saw blade is in contact with the wafer or portion of a wafer. The dicing saw 100 may also include a position sensor circuit/module 104 that senses the position of a wafer carrier 106 that is utilized to move the wafer or portion of the wafer into the saw blade to provide the saw cut path.

As is further illustrated in FIG. 4, a dicing saw controller 110 is operably associated with the dicing saw 100 to control the operation of the dicing saw 100. The dicing saw controller 110 may control the motion of the saw blade and/or the wafer carrier to provide a saw cut pattern and/or patterns. The dicing saw controller 110 also includes a dynamic saw cut module/circuit 112 that receives information from the contact sensor module/circuit 102 and/or the position sensor module/circuit 104 and controls the saw cut pattern and/or patterns based on such received information.

Operations of systems, methods and/or computer program products according to various embodiments of the present invention will now be described with reference to the flowchart illustrations of FIGS. 5 and 6. Such operations may be carried out by the system illustrated in FIG. 4 and may be provided, for example, by the dynamic saw cut module/circuit 112 as described further below. However, embodiments of the present invention are not limited to the particular system illustrated in FIG. 4 but include any system capable of carrying out the operations described herein.

Figure 5:
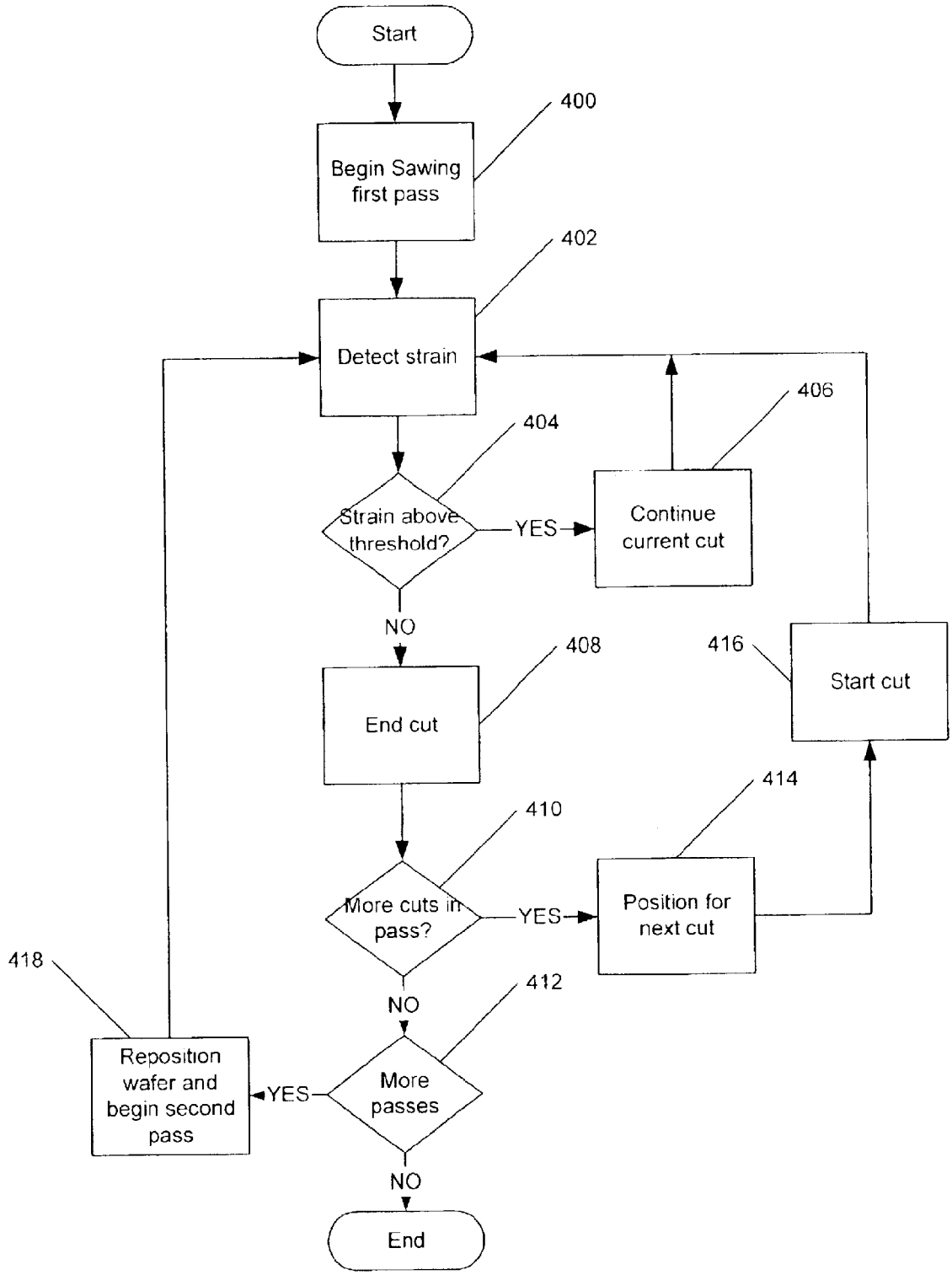
FIG. 5 is a flowchart illustrating operations for operating a dicing saw according to embodiments of the present invention.

As seen in FIG. 5, after mounting of a wafer or portion of the wafer into the wafer carrier 106, the dicing saw controller 110 positions the wafer carrier 106 to begin a first cut of a first sawing pass (block 400). The first saw pass may begin at a predefined point. In any event, strain in the saw is detected (block 402), for example, using the contact sensor 102, to determine when the saw blade is in contact with the wafer or portion of the wafer. If the detected strain is above a threshold value (block 404) the dynamic saw cut module/circuit 112 determines that the saw blade is in contact with the wafer or portion of the wafer and the cut is continued (block 406). Such a determination may be made a predefined time and/or distance of travel after the beginning of a cut so as to allow the blade an opportunity to contact the wafer or portion of a wafer. Thus, some minimum cut length may be provided irrespective of whether the detected strain is above the threshold that indicates that the saw blade is in contact with the wafer or portion of a wafer.

If the detected strain is not above a threshold value (block 404) after the predefined time and/or distance or travel or after the strain value having previously exceeded the threshold in the current cut, the dynamic saw cut module/circuit 112 determines that the saw blade is not in contact with the wafer or portion of the wafer and the cut is ended (block 408). If there are more cuts in the pass (block 410), the saw is positioned for the next cut (block 414) and a new cut is started (block 416) by the dynamic saw cut module/circuit 112 positioning the wafer carrier 106 at the start position of the next cut and the dicing saw controller 110 moving the wafer carrier 106 to make the cut. A determination of whether additional cuts are provided in the pass may be made, for example, by establishing a predefined number of cuts in a pass or by terminating a pass if it is detected that one or a series of cuts did not contact the wafer or portion of a wafer. The start position for the next cut may be made based on the position that saw blade first came into contact with the wafer or portion of the wafer in the current cut, may be based on information about the shape of the wafer or portion of a wafer obtained on a previous pass or may be predefined. Operations then continue from block 402 for the next cut.

If there are no more cuts in the pass (block 410), the dicing saw controller 110 determines if there are more passes (block 412). If there are more passes (block 412), the wafer carrier 106 is repositioned for the next pass the first cut of the pass is started (block 418). The repositioning of the wafer and starting of cuts of the second pass may, for example, be carried out by the dicing saw controller 110 and/or the dynamic saw cut module/circuit 112. The start position for the second pass may, for example, be a predefined start position or may be based on information obtained from the contact sensor 102 and/or the position sensor 104 during the first pass. Operations then continue from block 402 until there are no more saw cuts (block 410) and no more passes (block 412).

Thus, operations as illustrated in FIG. 5 may utilize information about the saw blade contacting the wafer and/or portion of a wafer to dynamically adjust the length of saw cuts and/or the starting position of saw cuts so as to reduce and potentially minimize the amount of time the wafer carrier is moved at a sawing rate of speed when the saw blade is not in contact with the wafer or portion of the wafer. Such a dynamic saw cut pattern may take into account differing shapes of portions of wafers, different wafer shapes or the like without requiring a prior knowledge or only minimal knowledge of the shape of the wafer or portion of the wafer.

Figure 6:
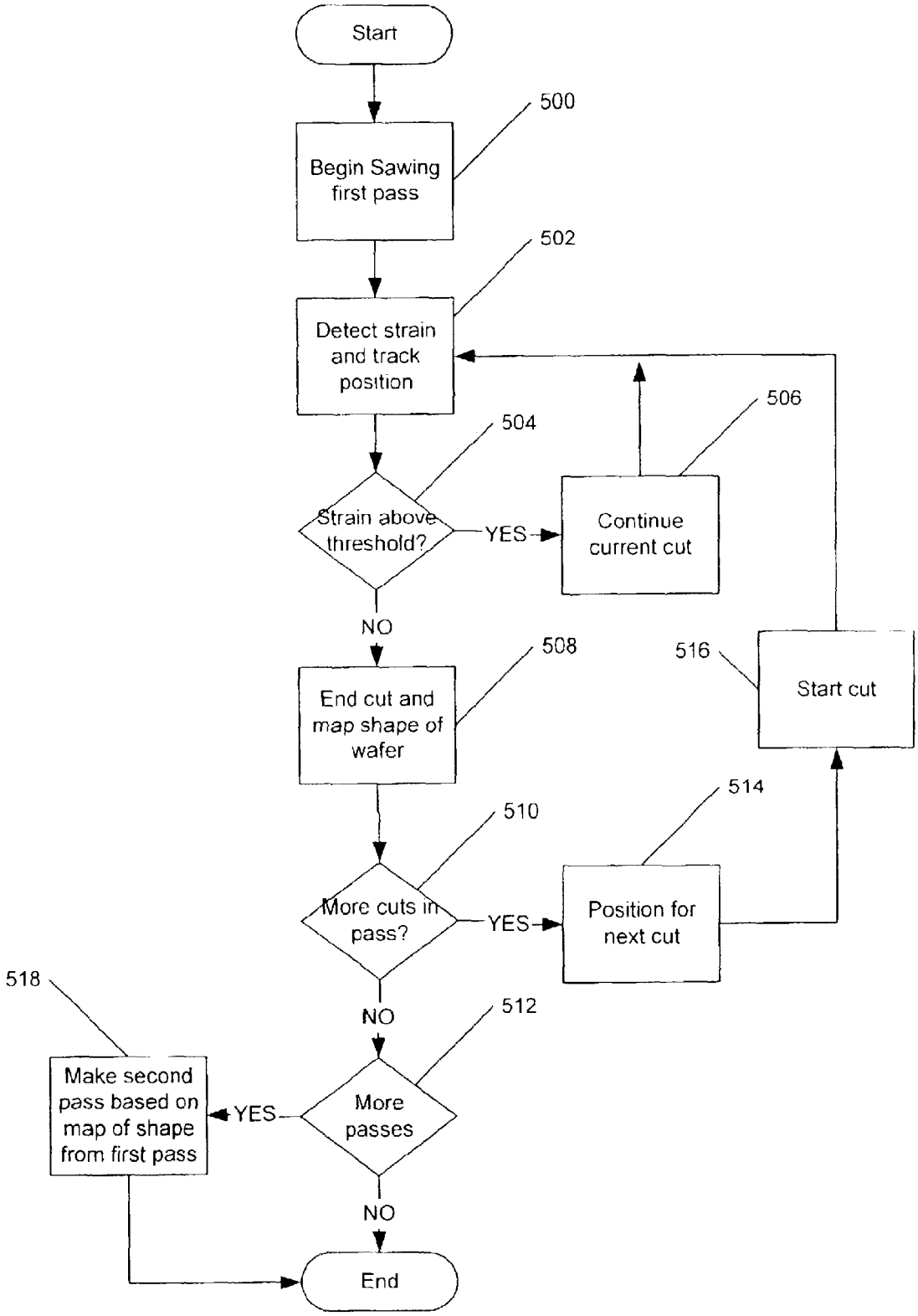
FIG. 6 is a flowchart illustrating operations for operating a dicing saw according to further embodiments of the present invention.

FIG. 6 illustrates further embodiments of the present invention where the first pass information is utilized to generate a map of the shape of the wafer or portion of the wafer that is used in determining a cut pattern for the second pass. As seen in FIG. 6, after mounting of a wafer or portion of the wafer into the wafer carrier 106, the dicing saw controller 110 positions the wafer carrier 106 to begin a first cut of a first sawing pass (block 500). Strain in the saw is detected, for example, using the contact sensor 102, to determine when the saw blade is in contact with the wafer or portion of the wafer and the position of the wafer carrier 106 is tracked and associated with the measured strain (block 502), for example, using the position sensor circuit/module 104. If the detected strain is above a threshold value (block 504) the dynamic saw cut module/circuit 112 determines that the saw blade is in contact with the wafer or portion of the wafer and the cut is continued (block 506) as described above with reference to FIG. 5.

If the detected strain is not above a threshold value (block 504) after the predefined time and/or distance or travel or after the strain value having previously exceeded the threshold in the current cut, the dynamic saw cut module/circuit 112 determines that the saw blade is not in contact with the wafer or portion of the wafer and the cut is ended (block 508). The positions where the strain first exceeded the threshold and last exceeded the threshold may be used by the dynamic saw cut module/circuit 112 to determine the shape of the wafer or portion of the wafer for the cut just completed (block 508). While the operations of block 508 are illustrated as being performed after each saw cut, such operations need not be performed after each saw cut but could be performed after a number of saw cuts or after all cuts in a pass.

If there are more cuts in the pass (block 510), the saw is positioned for the next cut (block 514) and a new cut is started (block 516) by the dynamic saw cut module/circuit 112 positioning the wafer carrier 106 at the start position of the next cut and the dicing saw controller 110 moving the wafer carrier 106 to make the cut. As described above, a determination of whether additional cuts are provided in the pass may be made, for example, by establishing a predefined number of cuts in a pass or by terminating a pass if it is detected that one or a series of cuts did not contact the wafer or portion of a wafer. The start position for the next cut may be made based on the position that saw blade first came into contact with the wafer or portion of the wafer in the current cut, may be based on information about the shape of the wafer or portion of a wafer obtained on a previous pass or may be predefined. Operations then continue from block 502 for the next cut.

If there are no more cuts in the pass (block 510), the dicing saw controller 110 determines if there are more passes (block 512). If there are more passes (block 512), the position information obtained from the cuts in the first pass is used to determine a map of the shape of the wafer or portion of a wafer and this map is then used to establish a cut pattern for the second pass and that pattern followed in making the second pass cuts (block 518). Optionally, the detection of strain may also be utilized in combination with the generated map in making the cuts of the second pass as was described above with reference to the first pass.

Thus, operations as illustrated in FIG. 6 may utilize information about the saw blade contacting the wafer and/or portion of a wafer to dynamically adjust the length of saw cuts and/or the starting position of saw cuts of a first pass and to generate a map of the wafer or portion of the wafer for use in a second pass so as to reduce and potentially minimize the amount of time the wafer carrier is moved at a sawing rate of speed when the saw blade is not in contact with the wafer or portion of the wafer. Such a dynamic saw cut pattern may take into account differing shapes of portions of wafers, different wafer shapes or the like without requiring a priori knowledge or only minimal knowledge of the shape of the wafer or portion of the wafer.

While the present invention has been described with reference to terminating a saw cut when a strain associated with the saw blade no longer exceeds a predefined threshold, such termination may occur immediately or may be delayed either in time or distance traveled after detecting that the strain falling below the threshold. Such a threshold may be adjusted, for example, based on cut depth, wafer thickness, blade wear, blade rotational speed or other such parameters that may change the level of strain associated with the blade contacting the wafer or a portion of a wafer. Also, while embodiments of the present invention have been described with reference to strain and a strain threshold that indicates that the saw blade is in contact with the wafer, other techniques for sensing that the saw blade is in contact with the wafer could also be utilized as described above.

Furthermore, while embodiments of the present invention have been described with reference to sawing through a wafer to provide individual dice, embodiments of the present invention may also be suitable for use in providing partial saw cuts that do not extend completely through a wafer. For example, such saw cuts may be used to provide substrate shaping and/or to score a substrate for subsequent singulation, for example, through breaking the substrate along score lines. Thus, the present invention should not be construed as limited to sawing completely through a substrate of a wafer.

The present invention is described herein with reference to flowchart illustrations and/or block and/or flow diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions specified in the flowchart and/or block and/or flow diagram block or blocks.

These computer program instructions may also be stored in a computer-readable memory that can direct a computer or other programmable data processing apparatus to function in a particular manner, such that the instructions stored in the computer-readable memory produce an article of manufacture including instruction means which implement the function specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions specified in the flowchart and/or block diagram block or blocks.

While embodiments of the present invention have been described with reference to a particular architecture and/or division of functions, the present invention should not be construed as limited to such architecture and/or division. Thus, other architectures and/or division of functions capable of carrying out the operations described herein may be utilized while still falling within the teachings of the present invention. Furthermore, while embodiments of the present invention have been described with reference to particular circuits, such circuits may include discrete components, processors, such as a microprocessor and/or signal processor, analog circuits, digital circuits and/or combinations thereof. Furthermore, embodiments of the present invention may be provided as an entirely hardware embodiment, an entirely software embodiment or combinations of hardware and software.

With regard to the operations illustrated in the flowcharts described above, as will be appreciated by those of skill in the art in light of the present disclosure, embodiments of the present invention are not limited to the specific sequence or sequences of operations described therein. Thus, for example, operations in the flowcharts may be provided out of sequence or concurrently. Similarly, other sequences of operations may be utilized while still providing the feedback adjustment according to embodiments of the present invention. Accordingly, the present invention should not be construed as limited to the particular operations or sequence of operations illustrated in the flowcharts.

In the drawings and specification, there have been disclosed embodiments of the invention, and, although specific terms have been employed, they have been used in a generic and descriptive sense only and not for purposes of limitation.

What is claimed is:

1. A method of controlling a semiconductor dicing saw, comprising:

dynamically adjusting a saw cut pattern of the semiconductor dicing saw during a sawing operation of at least a portion of a semiconductor wafer based on detection of a saw blade of the dicing saw contacting the semiconductor wafer;

wherein dynamically adjusting comprises:

terminating a current saw cut of the semiconductor dicing saw based upon detection that the saw blade no longer contacts the semiconductor wafer; and proceeding to a subsequent saw cut upon termination of the current saw cut; and wherein terminating a current saw cut comprises:

detecting that the saw blade no longer contacts the semiconductor wafer;

waiting a predefined time and/or distance of travel of the saw blade after it is detected that the saw blade no longer contacts the semiconductor wafer; and terminating the current saw cut if after the predefined time and/or distance the saw blade still no longer contacts the semiconductor wafer.

2. The method of claim 1, wherein proceeding to a subsequent saw cut further comprises beginning the subsequent saw cut at a start position based upon detection of when the saw blade is in contact with the semiconductor wafer during the current saw cut.

3. The method of claim 1, further comprising mapping a shape of at least a portion of the semiconductor wafer based on the dynamically adjusted saw cut pattern.

4. A method of controlling a semiconductor dicing saw, comprising:

dynamically adjusting a saw cut pattern of the semiconductor dicing saw during a sawing operation of at least a portion of a semiconductor wafer based on detection of a saw blade of the dicing saw contacting the semiconductor wafer;

wherein dynamically adjusting a saw cut pattern of the semiconductor dicing saw based on detection of a saw blade of the dicing saw contacting the semiconductor wafer comprises:

detecting a level of strain of the saw during a saw cut; and dynamically adjusting a saw cut pattern of the semiconductor dicing saw based on the detected level of strain indicating when the saw blade is contacting the semiconductor wafer; and wherein detecting a level of strain comprises detecting strain associated with a drive shaft of the saw and/or sensing current provided to a drive motor of the saw.

5. A method of controlling a semiconductor dicing saw, comprising:

dynamically adjusting a saw cut pattern of the semiconductor dicing saw during a sawing operation of at least a portion of a semiconductor wafer based on detection of a saw blade of the dicing saw contacting the semiconductor wafer;

wherein dynamically adjusting a saw cut pattern of the semiconductor dicing saw based on detection of a saw blade of the dicing saw contacting the semiconductor wafer comprises:

detecting a level of strain of the saw during a saw cut; and dynamically adjusting a saw cut pattern of the semiconductor dicing saw based on the detected level of strain indicating when the saw blade is contacting the semiconductor wafer; and wherein dynamically adjusting a saw cut pattern of the semiconductor dicing saw based on the detected level of strain indicating when the saw blade is contacting the semiconductor wafer comprises dynamically adjusting a saw cut pattern of the semiconductor dicing saw if the detected level of strain falls below a predefined strain threshold.

6. The method of claim 5, wherein the predefined strain threshold is based on cut depth, wafer thickness, blade wear and/or blade rotational speed.

7. The method of claim 5, wherein the wafer comprises a SiC wafer.

8. The method of claims 5, wherein at least one saw cut of the saw cut pattern does not extend completely through a thickness of the semiconductor wafer.

9. A method of controlling a semiconductor dicing saw, comprising:

dynamically adjusting a saw cut pattern of the semiconductor dicing saw during a sawing operation of at least a portion of a semiconductor wafer; and mapping a shape of at least a portion of the semiconductor wafer based on the dynamically adjusted saw cut pattern;

wherein mapping a shape comprises mapping a shape of the at least a portion of the semiconductor wafer based on detecting when the saw blade is contacting the at least a portion of the semiconductor wafer.

10. A method of controlling a semiconductor dicing saw, comprising:

dynamically adjusting a saw cut pattern of the semiconductor dicing saw during a sawing operation of at least a portion of a semiconductor wafer; and mapping a shape of at least a portion of the semiconductor wafer based on the dynamically adjusted saw cut pattern;

wherein mapping a shape is carried out based on a first cutting pass of the at least a portion of the semiconductor wafer.

11. The method of claim 10, further comprising establishing a path of the saw blade for a second cutting pass of the semiconductor wafer based on the mapped shape of the at least a portion of the semiconductor wafer.

12. A method of controlling a semiconductor dicing saw, comprising:

dynamically adjusting a saw cut pattern of the semiconductor dicing saw during a sawing operation of at least a portion of a semiconductor wafer based on detection of a saw blade of the dicing saw contacting the semiconductor wafer; and providing a minimum saw cut length for each saw cut irrespective of detection of the saw blade of the dicing saw contacting the semiconductor wafer.

13. The method of claim 12, wherein dynamically adjusting a saw cut pattern of the semiconductor dicing saw based on detection of a saw blade of the dicing saw contacting the semiconductor wafer comprises:

detecting a level of strain of the saw during a saw cut; and dynamically adjusting a saw cut pattern of the semiconductor dicing saw based on the detected level of strain indicating when the saw blade is contacting the semiconductor wafer.

* * * * *

UNITED STATES PATENT AND TRADEMARK OFFICE

CERTIFICATE OF CORRECTION

PATENT NO. : 6,945,844 B2
APPLICATION NO. : 10/606980
DATED : September 20, 2005
INVENTOR(S) : Hubbell, III It is certified that error appears in the above-identified patent and that said Letters Patent is hereby corrected as shown below:

On the Title Page,
Item 65, the second publication should read
-- US 2005/0159081 A9 Jul. 21, 2005 --

Signed and Sealed this

Nineteenth Day of September, 2006

JON W. DUDAS
*Director of the United States Patent and Trademark Office*